United States Patent [19]

Davies et al.

[11] 4,395,685

[45] Jul. 26, 1983

[54] WAVEGUIDE JUNCTION FOR PRODUCING CIRCULARLY POLARIZED SIGNAL

[75] Inventors: Arthur B. C. Davies, Sandown; Andrew P. Norris, Newport, both of England

[73] Assignee: Plessey Overseas Limited, Ilford, England

[21] Appl. No.: 259,482

[22] Filed: May 1, 1981

[30] Foreign Application Priority Data

May 1, 1980 [GB] United Kingdom ..... 8014553

[51] Int. Cl.[3] ..... H01P 1/17; H01P 5/12

[52] U.S. Cl. ..... 333/125; 333/137; 333/21 A

[58] Field of Search ..... 333/21 A, 125, 137, 333/248

[56] References Cited

U.S. PATENT DOCUMENTS

| | | | |
|---|---|---|---|
| 3,109,996 | 11/1963 | Allen | 333/137 |
| 3,201,717 | 8/1965 | Grosbois et al. | 333/125 |
| 3,284,725 | 11/1966 | Bowman | 333/125 |
| 3,955,202 | 5/1976 | Young | 333/21 A X |

*Primary Examiner*—Paul L. Gensler

*Attorney, Agent, or Firm*—Fleit, Jacobson & Cohn

[57] ABSTRACT

A microwave apparatus comprises a waveguide section including a stepped septum. The septum is positioned so as to divide the waveguide into two channels. The steps comprise a plurality of first steps which advance progressively in one direction and at least one second step, or the equivalent, which follows the first steps and which returns in an opposite direction. The invention is intended to enable the production of a circularly polarized microwave signal without requiring the use of phase adjustment techniques.

5 Claims, 5 Drawing Figures

WAVEGUIDE JUNCTION FOR PRODUCING CIRCULARLY POLARIZED SIGNAL

This invention relates to apparatus for microwave signal processing and more especially it relates to apparatus capable of producing a circularly polarized signal.

Techniques are known for producing a circularly polarized microwave signal and one such technique comprises the use of a stepped septum polarizer and is fully described in an article entitled "A Wide Band Square Waveguide Array Polarizer" by Ming Hui Chan and G. N. Tsandoulas in the I.E.E.E. Transactions on Antennas and propagation published in May 1973. This known system has however the acknowledged disadvantage that some phase adjustment is necessary which requires the use of phase compensation techniques if an acceptable circularly polarized signal is to be produced. One such compensation technique is described in the article and necessitates the use of a dielectric slab which is introduced into the microwave signal path. It will be appreciated that the use of compensation techniques is always generally undesirable and in the present case such compensation will not facilitate the production over a wide frequency band of a high quality circularly polarized signal.

It is an object of the present invention to provide a waveguide junction capable of producing a circularly polarized microwave signal without the disadvantage hereinbefore described.

According to the present invention microwave apparatus comprises a waveguide junction including a stepped septum which is positioned to divide the waveguide into two channels wherein the steps comprise a plurality of first steps which advance progressively in one direction and at least one second step or the equivalent which follows the first step and which returns in an opposite direction.

The waveguide section may be square and divided into similar channels of rectangular cross section by the septum.

The waveguide section may however have a cross section which has some other shape and it may be circular for example.

The steps in one embodiment of the invention are configured so that the first steps advance in one direction into the septum from one side of the wave guide and are followed by one second step which returns in the opposite direction to meet contiguously the opposing side of the waveguide.

The first of the first steps may be arranged to meet the said one side of the waveguide at a position which is opposite to the point at which the second step is contiguous with the opposing side of the waveguide.

There may be four first steps.

some embodiments of the invention will now be described with reference to the accompanying drawings in which.

Figure 1:
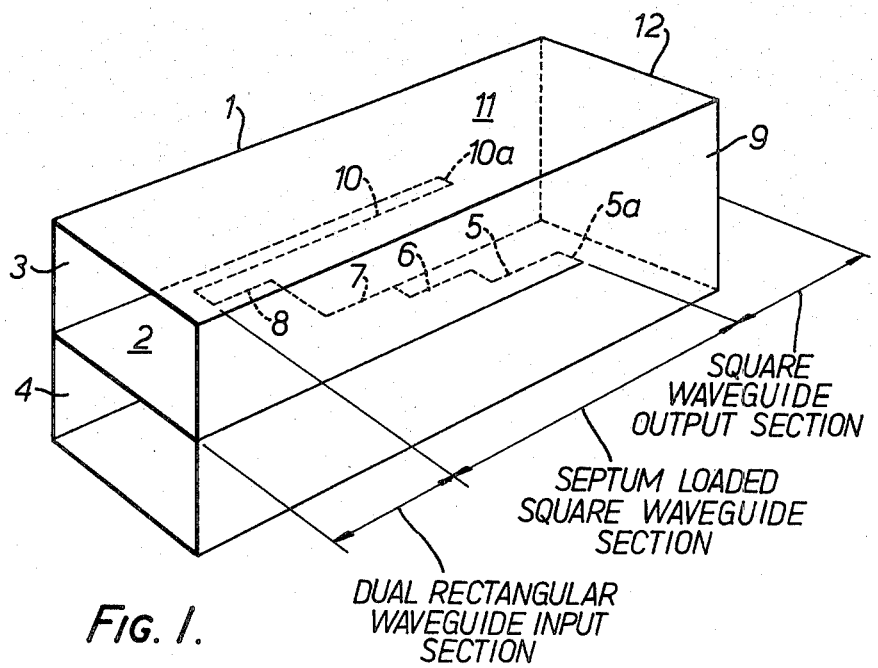
FIG. 1 is a somewhat schematic prospective view partly in section of a wide band septum polarizer.

Referring now to the drawings a wideband septum polarizer comprises a square wave guide section 1 divided by means of a septum 2 into two rectangular channels 3 and 4. The septum 2 is provided with four steps 5, 6, 7 and 8 which advance from a wall 9 of the waveguide section 1, and one second step 10 which returns in the opposite direction to meed and be contiguous with an opposing side wall 11 of the waveguide section 2. In the present example the top 5*a*, of the step 5 is arranged to be opposite to the top 10*a* of the second step 10.

The polarizer is fed with microwave signals which are launched into the rectangular channels 3 and 4. The channels 3 and 4 may be fed from a coaxial to waveguide transformer for example which is a device well known to those skilled in the art. Signals are produced at a square output end 12 of the waveguide section 1 which exhibit polarization characteristics determined by the relative phase and amplitude of input signals fed to the channels 3 and 4. For example if the channel 3 only is fed then output signals circularly polarized in one direction will be produced at the output end 12 of the waveguide 1, whereas if the channel 4 only is fed then circularly polarized output signals will be produced at the output end 12 of the waveguide which rotate in the opposite direction. If channels 3, 4 are fed with similar antiphase signals, horizontal linearly polarized signals will be produced at the output end 12, whereas if the input channels 3 and 4 are fed with inphase signals, vertical linearly polarized output signals will be produced.

The output and 12 of the polarizer may be arranged to feed a square waveguide run or could operate as an aerial feed. It will be appreciated that by varying the phase and/or amplitude of signals fed to the input channels 3 and 4, any kind of polarization from circular through elliptical to linear may be produced. It will also be appreciated that the polarizer is reversible and may be fed from the end 12 with polarized input signals to produce output signals from one or other or both of the channels 3 or 4 independent upon the character of the polarization fed to the end 12.

Figure 2A:
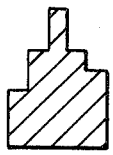
FIGS. 2*a*, 2*b* and 2*c* are shaded plan views of septums having alternative configurations for use with the polarizer of FIG. 1.
Figure 2B:
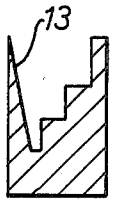
Figure 2C:
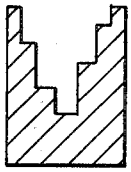

Various modifications may be made to the septum 2 of the polarizer. The number of steps provide will determine the band width over which the device will operate and for example a device as shown might be constructed to produce good quality circularly polarized signals over the frequency range 2,700 MHz to 3,300 MHz wherein phase shifts within 3° of optimum are achievable over the range. It is envisaged that various alternative designs of septum may be used as shown in FIGS. 2*a*, 2*b* and 2*c* for example, and in FIG. 2*b* a sloping return edge 13 is provided which is equivalent to a step.

Figure 3:
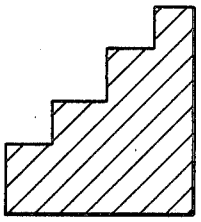
PRIOR ART FIG. 3.
FIG. 3 is a shaded plan view of a septum used in a known polarizer.

The design of septum used in a known system is shown in FIG. 3 which requires the use of phase compensation, but by utilizing a return step as shown in FIGS. 1, 2*a*, 2*b*, and 2*c* a significant improvement in performance is achieved whereby high purity circular polarization of an output signal is producible without the need for phase shifting devices.

It is envisaged that a polarizer as just before described may be used for the production of high purity circular polarization in a square waveguide radiating element for a planar array antenna. Apparatus according to the invention may however be used to provide circularly polarized signals for a reflector and line source antennas.

It is also contemplated that the polarizer may be used in reverse to divide an incoming signal, which may be a radar signal echo, into signals characteristic of their cross-polar and co-polar components.

We claim:

1. A junction between three waveguides in which one of the waveguides is formed in a channel of uniform cross section and is divided into two parallel waveguide channels so as to define the other two of the three waveguides by an asymmetrical stepped septum comprising first step means including a plurality of first steps which advance progressively in one direction and second step means including at least one second step which follow the first step means and which returns in an opposite direction.

2. A waveguide junction as claimed in claim 1 wherein the said one waveguide is square in cross section and divided into similar channels of rectangular cross sections by the septum.

3. A waveguide junction as claimed in claim 2 wherein the step means are configured so that the first steps advance in one direction into the septum from one side of the waveguide and are followed by one second step which returns in the opposite direction to meet contiguously the opposing side of the waveguide.

4. A waveguide junction as claimed in claim 3 wherein the first of the first step means is arranged to meet the side of the waveguide at a position which is opposite to the point at which the second step means is contiguous with the opposite side of the waveguide.

5. A waveguide junction as claimed in claim 4 wherein said first step means comprises four steps.

* * * * *